United States Patent [19]

Fourezon

[11] Patent Number: 4,576,858

[45] Date of Patent: Mar. 18, 1986

[54] MATERIAL BASED ON A NON-WOVEN TEXTILE LAP WHICH MAY BE USED AS REINFORCEMENT FOR IMPERMEABLE COVERINGS

[75] Inventor: André Fourezon, Le Cheylard, France

[73] Assignee: Establissements les Fils d'Auguste Chomarat et Cie, Paris, France

[21] Appl. No.: 717,867

[22] Filed: Mar. 29, 1985

[30] Foreign Application Priority Data

Apr. 6, 1984 [FR] France ..... 84 05693

[51] Int. Cl.[4] ..... B32B 5/06

[52] U.S. Cl. ..... 428/300; 428/301

[58] Field of Search ..... 428/300, 301, 234, 235, 428/139, 140

[56] References Cited

U.S. PATENT DOCUMENTS

| | | | |
|---|---|---|---|
| 3,044,146 | 7/1962 | Thomas et al. . | |
| 3,950,587 | 4/1976 | Colijn et al. | 428/234 |
| 3,967,032 | 6/1976 | Plotz et al. | 428/301 X |
| 4,368,228 | 1/1983 | Gorgati . | |

FOREIGN PATENT DOCUMENTS

| | | |
|---|---|---|
| 2243293 | 4/1975 | France . |
| 1517595 | 7/1978 | United Kingdom . |

*Primary Examiner*—Alexander S. Thomas

*Attorney, Agent, or Firm*—Parkhurst & Oliff

[57] ABSTRACT

The present invention relates to a material which may be used as reinforcement for bituminous impermeable coverings of the type constituted by a non-woven fibrous lap. The material being characterized in that the lap is formed by a complex comprising an intermediate layer constituted by a non-woven fabric of polyester. The non-woven fabric serving as a support for glass fibers implanted in its thickness. The fibers project on each side of said support and are folded back thereon.

4 Claims, 1 Drawing Figure

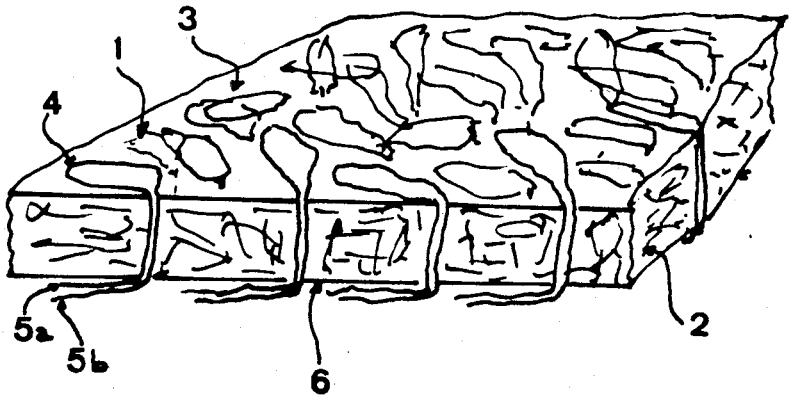
3
1
4
5a
5b
6
2

MATERIAL BASED ON A NON-WOVEN TEXTILE LAP WHICH MAY BE USED AS REINFORCEMENT FOR IMPERMEABLE COVERINGS

BACKGROUND OF THE INVENTION

The present invention relates to a material based on a non-woven textile lap which may be used as reinforcement for impermeable coverings constituted by a support embedded in a bitumen composition.

Such impermeable coverings based on bitumen reinforced by a textile structure have been known for a very long time.

The most ancient is the one used by Noah to construct his ark.

In fact, as the Old Testament clearly states, in Genesis Chapter 6, Verse 14, before the flood, God said to Noah: "Make yourself an ark with ribs of cypress; cover it with reeds and *coat it inside and out with pitch*" (New English Bible version).

This clearly shows that water-tight materials based on bitumen reinforced by a structure serving as support were known.

Since that time, such materials have always been used, particularly for making roofing for buildings. The reinforcements were, of course, developed at the same time as new textile materials and/or structures based on these materials appeared in the market.

For instance, it has been proposed to use chemical films, woven fabrics, non-woven fabrics, based on synthetic or inorganic matters (glass for example) as reinforcements.

It has also been envisaged to use felts based on glass fibers, woven or non-woven structures (French Pat. Nos. 1 330 291, 1 491 454), and even to make non-woven/woven fabric complexes in which the different layers are joined together by seams (U.S. Pat. No. 3,044,146) and/or to associate laps based on different textile material. For example, a non-woven fabric made of polyester and a web of glass fibers.

However, not all the materials up to the present time enable a fibrous complex to be obtained economically at a high speed, easy to manipulate, and to store and which presents all the qualities required when desired to make an one-layer impermeable covering, namely very good mechanical properties, a dimensional stability and an excellent punch resistance, both from the static and dynamic standpoint.

The most appropriate material answering all these characteristics is, according to the present invention, constituted by a complex formed by a non-woven fabric made of polyester associated on one of its faces with a textile grid made of glass.

The complex is marketed by Applicants under reference 603 GP 70.

The complex gives very good results but requires complex installations for making it.

A novel type of fibrous complex has now been found, and is the subject matter of the present invention which not only makes it possible to obtain the characteristics desired for the impermeable covering based on bitumen and more particularly one-layer coverings, but also may be produced at high speed, easy to store and to handle, presents a very good dimensional stability and an excellent punch resistance both from the dynamic and static standpoint.

SUMMARY OF THE INVENTION

The present invention generally relates to a material which may be used as reinforcement for bituminous impermeable coverings, said material being of the type constituted by a non-woven fibrous lap and being characterized in that said lap is formed by a complex comprising an intermediate layer constituted by a non-woven fabric of polyester. The non-woven fabric serving as support for glass fibers implanted in its thickness, which fibers project on each side of said support and are folded back thereon.

The inner lap based on polyester is, preferably a non-woven fabric made from continuous filaments, relatively compact and of small thickness. The glass fibers are implanted in the non-woven fabric by needling.

The material is obtained by simply superposing the inner polyester lap with a lap of glass fibers, said glass fibers having a length such that when the whole is subjected to a needling operation, they are implanted in the lap of polyester and emerge on the face opposite the one where the action of the needles is exerted, in the form of loops.

The assembly thus produced is then calendered and possibly impregnated with an adhesive matter of known type compatible with the bitumen.

BRIEF DESCRIPTION OF THE DRAWING

The invention will be more readily understood by reading the following description with reference to the accompanying drawings, in which:

The single FIGURE illustrates an embodiment of the material according to the invention.

DETAILED DESCRIPTION OF THE INVENTION

A material according to the present invention is made on a conventional installation for associating non-woven laps. The installation essentially comprising a needling device at the outlet of which is disposed an impregnation tank, a calender and a drying oven.

A lap of polyester weighing 70 g/m$^2$ and a lap of glass fibers weighing 150 to 160 g/m$^2$, the fibers having a length of between 100 and 150 mm, are introduced, superposed, in such an installation.

The lap of the glass is disposed above the lap of polyester such that the needles of the needling device entrain the glass fibers through the lap of polyester.

According to the present invention, as is clearly shown in the accompanying FIGURE, the needling device is adjusted such that, the glass fibers 1 pass through the lap 2 of polyester and project on each side thereof. After calendering, for example, on one of the face 3 of the lap 2, the glass fibers 1 are in the form of flattened loops 4 while, on the other side, i.e. on the side 6 by which the needles penetrate, said glass fibers 1 present two free ends 5*a*, 5*b* likewise flattened against the face 6 of the lap 2.

After needling, the assembly passes in an impregnation tank containing a bonding matter, for example, a glue of the styrenebutadiene type, then between two rolls for squeezing the assembly and for flattening the glass fibers against the faces of the polyester lap. In the present case the glue is deposited at a rate of 130 g/m$^2$.

The complex thus produced, may be stored in the form of a long-length winding in order thereafter to be coated with a layer of bitumen so as to obtain a water-tight assembly four millimeters thick.

This assembly presents excellent characteristics of dimensional stability and of static and dynamic punch resistance, rendering it particularly appropriate for making an one-layer impermeable covering.

Moreover, the basic textile complex may easily be stored and manipulated which presents a certain advantage in general, that the bitumen covering is made by industrialists other than those manufacturing the reinforcements.

The invention is of course not limited to the embodiment described hereinabove but covers all the variations thereof made in the same spirit. For example, although in the embodiment described above, one single glass lap and one single polyester lap are used for making the complex, it may be envisaged to imprison the polyester lap between two glass laps, the assembly then being subjected to needling on both faces. Moreover, other additional reinforcing elements such as, for example, a non-woven grid, a film, may be interposed between the fibers of polyester and glass.

What is claimed is:

1. A material which may be used as reinforcement for bituminous impermeable coverings of the type constituted by a non-woven fibrous lap, said lap being formed by a complex comprising an intermediate layer constituted by a non-woven fabric of polyester, said non-woven fabric serving as a support for glass fibers implanted therein, said fibers projecting on each side of said non-woven fabric and folded back thereon.

2. The material of claim 1, wherein the lap is a non-woven fabric made from relatively compact continuous filaments of small -thickness, and the glass fibers are implanted in the non-woven fabric by a needling operation.

3. The material of claim 2, wherein the length of said glass fibers is such that, during said needling operation, said glass fibers are implanted in the lap of said non-woven fabric of polyester and emerge in the form of loops on side opposite to the side where the needles are inserted.

4. The material of claim 1, wherein after said material has been made, it is calendered and impregnated with an adhesive matter.

* * * * *